US006158356A

United States Patent [19]

Hachet et al.

[11] Patent Number: 6,158,356

[45] Date of Patent: Dec. 12, 2000

[54] ENERGY ABSORBER DEVICE HAVING A PARALLELEPIPED SHAPE FOR ABSORBING IMPACTS TO A VEHICLE

[75] Inventors: Joël Hachet, La Jarrie; Michel Gibeau, La Jarne; Jean-Jacques Laporte, La Rochelle, all of France

[73] Assignee: GEC Alsthom Transport SA, Paris, France

[21] Appl. No.: 09/020,344

[22] Filed: Feb. 9, 1998

[30] Foreign Application Priority Data

Feb. 10, 1997 [FR] France ..... 97 01 480

[51] Int. Cl.[7] ..... B61D 17/00

[52] U.S. Cl. ..... 105/392.5; 105/26.05

[58] Field of Search ..... 105/5, 8.1, 9, 10, 105/11, 15, 16, 17, 18, 26.05, 392.5, 456; 296/187, 189, 190.04, 190.05, 190.06, 190.07, 190.08; 213/220, 222, 221; 267/160, 3, 7; 293/24, 27, 132, 134

[56] References Cited

U.S. PATENT DOCUMENTS

| | | | |
|---|---|---|---|
| 1,693,412 | 11/1928 | Taylor . | |
| 1,875,214 | 8/1932 | Buderus | 105/3 |
| 2,012,260 | 8/1935 | Martin | 105/3 |
| 2,843,417 | 7/1958 | Wahl et al. | 105/3 |
| 2,844,107 | 7/1958 | Miers et al. | 105/3 |
| 3,678,864 | 7/1972 | Gutridge | 105/4.1 |
| 4,715,292 | 12/1987 | Pavlick et al. | 105/392.5 |
| 5,785,368 | 7/1998 | Hartmann et al. | 293/134 |
| 5,810,427 | 9/1998 | Hartmann et al. | 296/189 |

FOREIGN PATENT DOCUMENTS

| | | |
|---|---|---|
| 2715904 | 8/1995 | France . |
| 482279 | 9/1929 | Germany . |
| 11 23 696 | 2/1962 | Germany . |

*Primary Examiner*—Mark T. Le
*Attorney, Agent, or Firm*—Sughrue, Mion, Zinn Macpeak & Seas, PLLC

[57] ABSTRACT

An energy absorber device for use in vehicles, in particular railroad vehicles, is of generally parallelepipedal shape and can be inserted between a driver's cab and a coach-body. The larger opposite faces of the parallelepiped are disposed in a plane formed by the rear face of the driver's cab and in a plane formed by the front face of the coach-body, respectively.

21 Claims, 4 Drawing Sheets

ENERGY ABSORBER DEVICE HAVING A PARALLELEPIPED SHAPE FOR ABSORBING IMPACTS TO A VEHICLE

BACKGROUND OF THE INVENTION

1. Field of the Invention

The present invention concerns energy absorber devices in general and in particular energy absorber devices for use in vehicles, in particular in railroad vehicles.

2. Description of the Prior Art

In the prior art, light impacts to the front of a vehicle, in particular a railroad vehicle, are absorbed by means of a bumper mounted on absorbing members or on a coupling.

Such impacts can also be absorbed by means of buffers which undergo a small displacement in the direction of the impact.

Energy absorber devices must necessarily allow large amplitude displacements to absorb an impact of greater magnitude.

One prior art solution is to use deformable box-sections.

The major drawback of these prior art deformable box-sections is that they cannot be placed at the front of the vehicle because they would constitute an unacceptable increase in the length of the vehicle.

One solution to this technical problem known in itself consists in integrating these deformable box-sections into the chassis under the driver's cab.

A major drawback of this solution is that the deformation of the prior art deformable box-sections leads to deformation of the driver's cab and therefore to greater or lesser deformation of the windshield and the control panel, for example.

The driver in the driver's cab can therefore be injured in the event of a head-on impact.

Accordingly, one aim of the invention is an energy absorber device including an absorber device of the above kind that does not have the drawbacks of the prior art energy absorber devices.

Another aim of the invention is an energy absorber device enabling the driver's cab to remain intact after a head-on or slightly oblique collision.

SUMMRY OF THE INVENTION

An energy absorber device in accordance with the invention is of generally parallelepipedal shape and is adapted to be disposed between a driver's cab and a coach-body.

Larger opposite faces of the parallelepiped are disposed in a plane formed by a rear face of the driver's cab and in a plane formed by a front face of the coach-body, respectively.

The energy absorber device of the invention also has at least one of the following features:

the device includes:

a first flat ring and a second flat ring, which face each other without being in contact, pivot members attached to an upper part of the first and second flat rings and defining a radial pivot axis X—X in a top part of the driver's cab, at least one damper device disposed in a bottom part of the first and second flat rings, energy being absorbed in a lengthwise direction of the driver's cab, and a cab chassis disposed in a bottom part of the driver's cab and attached to the bottom part of the first and second flat rings, a rear end of the cab chassis is attached a least to the bottom part of the first flat ring, each damper device penetrates at least partially into the cab chassis, each damper device is confined between the top parts of the first and second flat rings, at least one of the damper devices penetrates at least partially into the cab chassis, the other damper devices being confined between the top parts of the first and second flat rings, at least one damper device includes a front member adapted to slide in a fixed member, a rear end of the fixed member of the damper device bears on the bottom part of the second flat ring, a front end of the fixed member passes through an orifice in the first flat ring and the front member of the damper device is attached to the bottom part of the first flat ring and is held in an initial position at the front end of the fixed member, the damper devices are of generally cylindrical shape, the front members of the damper devices are accommodated in said cab chassis, each damper device comprises a honeycomb type structure disposed between the bottom parts of the first and second flat rings, the first flat ring is parallel to the rear face of the driver's cab and the second flat ring is parallel to the front face of the coach-body, the bottom part of the second flat ring, on which the rear end of the fixed members bears, bears on the chassis of the coach-body, each pivot member comprises a first yoke and a second yoke, each pivot member comprises a ball-joint cooperating with a sliding bearing, the cab chassis has on its front part front dampers adapted to damp light impacts.

In accordance with another feature of the invention, a vehicle, in particular a railroad vehicle, includes an energy absorber device in accordance with the invention.

An advantage of the energy absorber device of the invention is that it prevents destruction of the driver's cab in the event of an impact.

Another advantage of the energy absorber device of the invention is that the device can be fitted as required.

Another advantage of the energy absorber device of the invention is that its damping capacities can be changed.

Another advantage of the energy absorber device of the invention is that the characteristics of the driver's station are not penalized, namely: roominess, visibility, ergonomics.

Another advantage of the energy absorber device of the invention is that it can be used more than once.

Another advantage of the energy absorber device of the invention is that the vehicle can be returned to service quickly after a collision.

Another advantage of the energy absorber device of the invention is the facility to use proven absorber subassemblies to reduce costs.

Other aims, features and advantages of the invention will become apparent from a reading of the description of the preferred embodiment of the energy absorber device given in the case of a railroad vehicle and with reference to the drawings.

DETAILED DESCRIPTION OF THE PREFERRED EMBODIMENT

Figure 1:
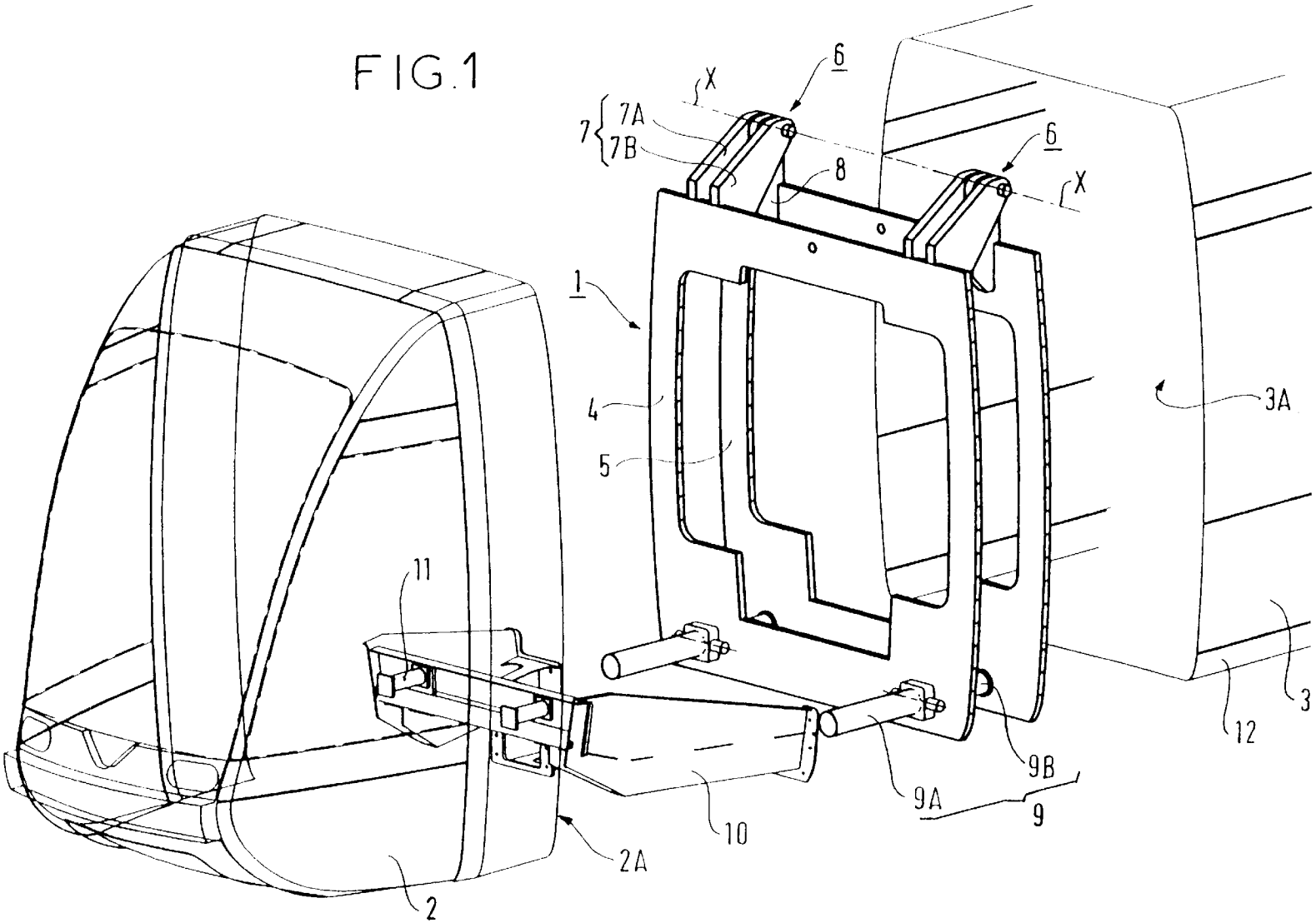
FIG. 1 is an exploded view of a preferred embodiment of the energy absorber device of the invention.

FIG. 1 is an exploded view of the energy absorber device of the invention.

In accordance with the invention, the energy absorber device 1 is of generally parallelepipedal shape and is adapted to be inserted between a driver's cab and a coach-body 3.

The larger opposite faces of the parallelepiped are disposed in a plane formed by the rear face 2A of the driver's cab 2 and in a plane formed by the front face 3A of the coach-body 3, respectively.

The energy absorber device 1 includes a first flat ring 4 and a second flat ring 5 which face each other without touching.

The first flat ring 4 is parallel to the rear race 2A of the driver's cab 2 and the second flat ring 5 is parallel to the front face 3A of the passenger compartment 3.

The first and second flat rings 4 and 5 are attached at the top to pivot members 6.

The pivot members 6 define a pivot axis X—X that is radial with respect to the driver's cab.

Each pivot member 6 includes a first yoke 7 and a second yoke 8, for example.

The first and second yokes 7 and 8 can comprise a plurality of members 7A and 7B, the combination thereof constituting the yoke.

The bottom part of the first yoke 7 is fixed to the top part of the first flat ring 4.

Similarly, the bottom part of the second yoke 8 is fixed to the top part of the second flat ring 5.

The bottom part of the energy absorber device 1 includes at least one damper device 9 the characteristics of which are such that energy is absorbed in the lengthwise direction of the driver's cab.

To obtain the benefit of a wide absorption curve and therefore to absorb heavy impacts, it is preferable for the damper devices 9 to penetrate at least partially into the cab chassis 10.

In the case of light impacts, the damper devices 9 are confined between the bottom parts of the first and second flat rings 4 and 5.

It is clear that it is possible to combine or to juxtapose both types of damper device 9.

Each damper device 9 has a front member 9A adapted to slide in a fixed member 9B, for example.

The rear end of the fixed member 9B of the damper device 9 bears on the bottom part of the second flat ring 5.

The front member 9A is attached to the bottom part of the first flat ring 4 and is held in an initial position at the front end of the fixed member 9B.

The damper device 9 is of generally cylindrical shape, for example.

A cab chassis 10 disposed in a manner known in itself in the bottom part of the driver's cab 2 accommodates the front members 9A of the damper devices 9.

Figure 2:
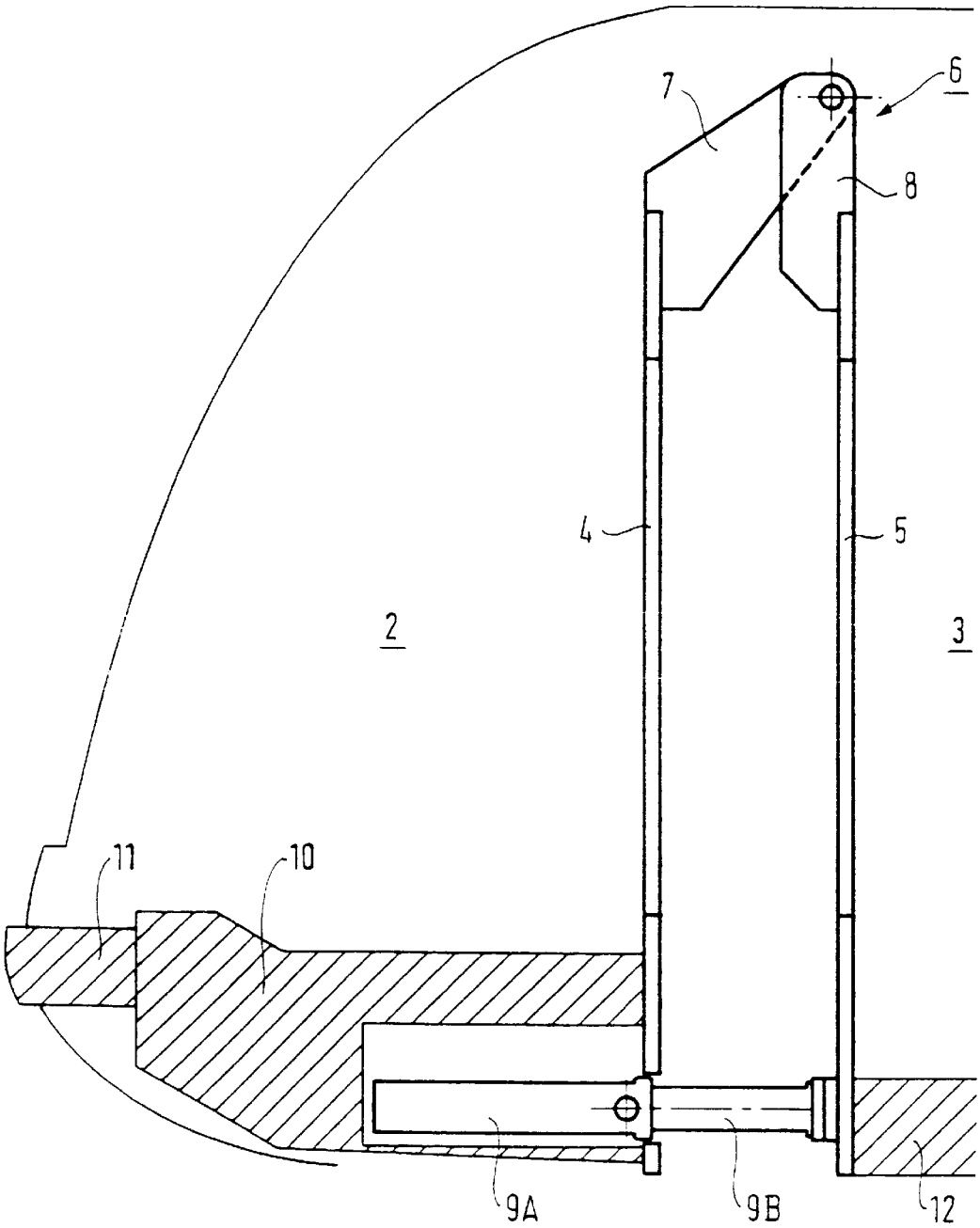
FIGS. 2 to 4 are lateral views of the energy absorber device of the invention in successive initial, intermediate and maximum positions.

In the embodiment shown in FIG. 2 the front members 9A are not in contact with the cab chassis 10.

The cab chassis 10 can have front dampers 11 on the front adapted to damp light impacts.

Figure 3:
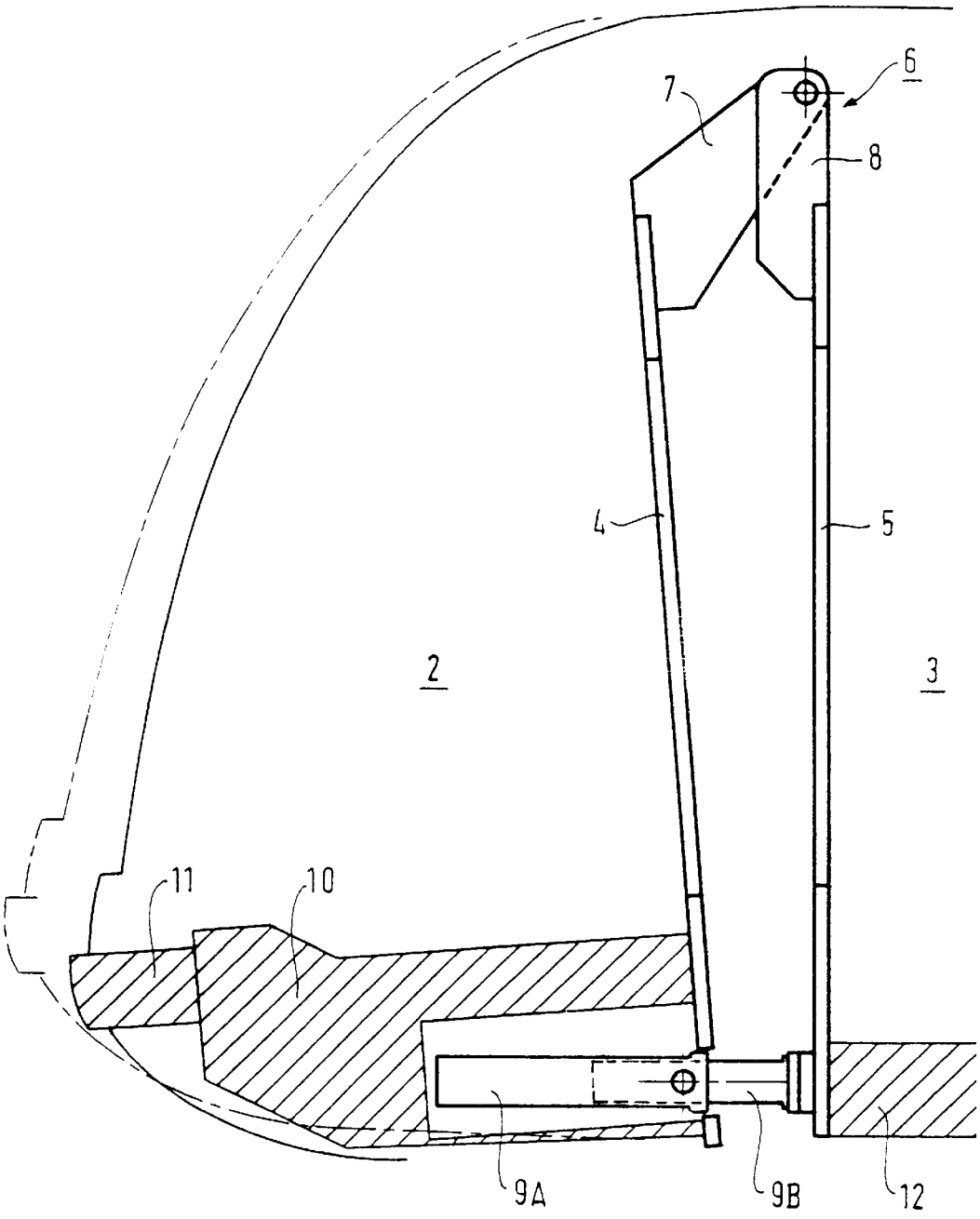
Figure 4:
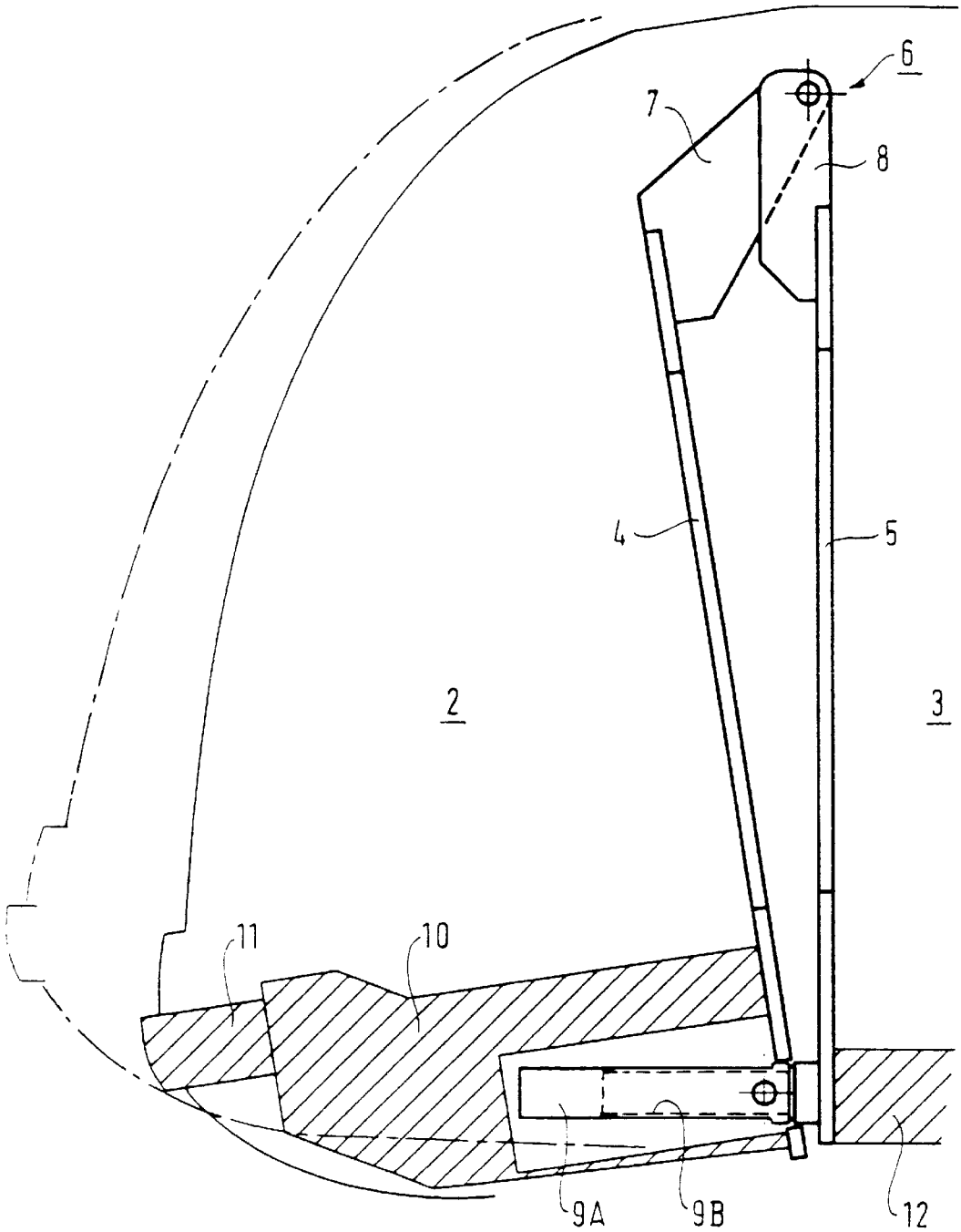

FIGS. 2 to 4 are lateral views of the energy absorber device of the invention in successive initial, intermediate and maximum positions.

As previously indicated, the rear end of the fixed member 9B of the damper device 9 bears on the bottom part of the second flat ring 5.

The front end of the fixed member 9B passes through orifice in the first flat ring 4.

The bottom part of the second flat ring 5, on which the rear end of the fixed member 9B bears, bears on the chassis 12 of the coach-body constituting the passenger compartment 3.

The front member 9A is attached to the bottom part of the first flat ring 4 and is held in an initial position at the front end of the fixed member 9B.

The rear end of the cab chassis 10 is also attached to at least the bottom part of the first flat ring 4 so as to be able to accommodate the front members 9A of the damper devices 9.

As a result of the foregoing, the bottom part of the first flat ring 4 can pivot about the pivot axis radial relative to the driver's cab, the second flat ring remaining fixed against the coach-body constituting the passenger compartment 3.

As shown in FIG. 2, in the initial position the first and second flat rings 4 and 5 are parallel.

As shown in FIGS. 3 and 4, in the intermediate and maximum positions the first and second flat rings 4 and 5 are no longer parallel.

The damper devices 9 operate like pistons and enable the energy absorber device 1 to dissipate the energy associated with an impact.

The pivot member 6 of the energy absorber device 1 obliges the first flat ring 4 to rotate and controls the direction of deformation in such a manner as to transmit the load towards the chassis 12 of the coach-body.

The result of the foregoing is that the energy absorber device of the invention is able to absorb impacts in a direction at an angle to the direction of movement of the vehicle.

The energy associated with the mass and with the speed of vehicles is stored by the energy absorber device 1 in the event of an impact to the front of the cab chassis 10 or the front dampers 11.

This energy absorber device therefore protects the driver's cab to improve driver safety.

The energy absorber device is reversible and can therefore sustain more than one impact.

The energy absorber device can therefore be used to complement the front dampers 11.

Each damper device 9 can also include, in an embodiment that is not shown, a honeycomb type structure disposed between the bottom parts of the first and second flat rings 4 and 5.

In another embodiment, also not shown, each pivot member 6 can be a ball-joint cooperating with a sliding bearing.

What is claimed is:

1. An energy absorber device of a generally parallelepipedal shape disposed between a driver's cab and a coach body, comprising:

two flat rings; and a damper device interconnected therebetween said two flat rings for damping energy resulting from an impact to the driver's cab.

2. An energy absorber disposed between a driver's cab and a coach body, comprising:

energy absorbing means for absorbing energy resulting from an impact on the driver's cab, wherein said energy absorbing means includes damper means for damping the energy.

3. An energy absorber device of generally parallelepipedal shape adapted to be disposed between a driver's cab and a coach-body comprising:

a first flat ring and a second flat ring which face each other without being in contact, pivot members attached to an upper part of said first and second flat rings and defining a radial pivot axis in a top part of said driver's cab, at least one damper device disposed in a bottom part of said first and second flat rings, to absorb energy in a lengthwise direction of said driver's cab, and said bottom part of said first and second flat rings adapted to be attached to a cab chassis disposed in a bottom part of said driver's cab.

4. A device as claimed in claim 3 wherein at least a bottom part of said first flat ring is adapted to be attached to a rear end of said cab chassis.

5. The device claimed in claim 3 wherein each damper device is adapted to penetrate at least partially into said cab chassis.

6. The device claimed in claim 3 wherein said at least one damper device is adapted to be confined between top parts of said first and second flat rings.

7. The device claimed in claim 3 wherein said at least one said damper device is adapted to penetrate at least partially into said cab chassis, and other damper devices being confined between top parts of said first and second flat rings.

8. The device claimed in claim 3 wherein said at least one damper device includes a front member adapted to slide in a fixed member.

9. The device claimed in claim 8 wherein a rear end of said fixed member of said damper device bears on a bottom part of said second flat ring, a front end of said fixed member passes through an orifice in said first flat ring and said front member of said damper device is attached to said bottom part of said first flat ring and is held in an initial position at a front end of said fixed member.

10. The device claimed in claim 9 wherein said damper devices are of generally cylindrical shape.

11. The device claimed in claim 8 wherein said front members of said at least one damper damper device is adapted to be accommodated in said cab chassis.

12. The device claimed in claim 3 wherein each damper device comprises a honeycomb type structure disposed between said bottom parts of said first and second flat rings.

13. The device claimed in claim 3 wherein said first flat ring is adapted to be parallel to said rear face of said driver's cab and said second flat ring is adapted to be parallel to said front face of said coach-body.

14. The device claimed in claim 13 wherein said bottom part of said second flat ring, on which said rear end of said fixed member bears, is adapted to bear on said chassis of said coach-body.

15. The device claimed in claim 3 wherein each pivot member comprises a first yoke and a second yoke.

16. The device claimed in claim 3 wherein each pivot member comprises a ball-joint cooperating with a sliding bearing.

17. The device claimed in claim 3 wherein said energy absorbing device is adapted to help absorb impacts to front dampers located on a front of said cab chassis.

18. An energy absorber device of generally parallelepipedal shape in combination with a driver's cab and a coach-body, said energy absorber device being disposed between said driver's cab and said coach-body, wherein said energy absorber device stores energy associated with a mass and speed of the driver's cab in the event of an impact to the driver's cab in order to protect a driver in the driver's cab.

19. The combination claimed in claim 1 wherein opposite faces of said parallelepipedal shape are disposed in a plane formed by a rear face of said driver's cab and in a plane formed by a front face of said coach-body, respectively.

20. The combination claimed in claim 18, adapted to be parts of a railroad vehicle.

21. The combination claimed in claim 18, wherein opposite faces of said parallelepipedal shape are disposed in a plane parallel to a rear face of said driver's cab and in a plane parallel to a front face of said coach-body, respectively.

* * * * *